US006782790B2

(12) United States Patent
Barrett

(10) Patent No.: US 6,782,790 B2
(45) Date of Patent: Aug. 31, 2004

(54) METHOD FOR DEFLECTING FAST PROJECTILES

(75) Inventor: John L. Barrett, Pelham, NH (US)

(73) Assignee: Bae Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 10/324,553

(22) Filed: Dec. 20, 2002

(65) Prior Publication Data

US 2004/0118270 A1 Jun. 24, 2004

(51) Int. Cl.[7] ..... F41H 11/02
(52) U.S. Cl. ..... 89/1.11; 89/36.17
(58) Field of Search ..... 89/1.11, 1.1, 36.17

(56) References Cited

U.S. PATENT DOCUMENTS 3,719,829 A * 3/1973 Vaill
4,359,944 A * 11/1982 Stiennon ..... 89/1.1
5,198,607 A * 3/1993 Livingston et al. ..... 89/1.11
5,400,688 A * 3/1995 Eninger et al. ..... 89/1.11
5,495,787 A * 3/1996 Boyer, III ..... 89/1.11
5,814,753 A * 9/1998 Rieger ..... 89/1.11
5,824,941 A 10/1998 Knäpper
6,029,558 A 2/2000 Stevens et al.
6,244,156 B1 6/2001 Steuer et al.

FOREIGN PATENT DOCUMENTS

DE 27 40 238 A1 * 3/1979 ..... 89/1.11

OTHER PUBLICATIONS

Vogel; Lasers Devies and Systems–Part III; Electronics; Nov. 1961.*

* cited by examiner

*Primary Examiner*—Stephen M. Johnson
(74) *Attorney, Agent, or Firm*—Daniel J. Long

(57) ABSTRACT

A method for deflecting a projectile from an initial trajectory. Such a projectile has a first surface area and a second surface area and moves through a gaseous atmosphere with a surrounding plasma sheath. This method includes the step of directing electromagnetic radiation toward the projectile, wherein the electromagnetic radiation has a wavelength which is absorbed by the plasma sheath but is not substantially absorbed by the gaseous atmosphere.

20 Claims, 1 Drawing Sheet

METHOD FOR DEFLECTING FAST PROJECTILES

BACKGROUND OF THE INVENTION

1. Field of the Invention

The present invention relates to ordnance and more particularly to methods and apparatus for providing shielding from fast moving projectiles.

2. Brief Description of Prior Developments

The prior art discloses various methods and apparatus for shielding or protecting potential targets, including surface vehicles, aircraft, gun emplacements, ships, troop concentrations and the like from projectiles.

U.S. Pat. No. 5,635,260 to Rudolf, et al. discloses an arrangement for protecting an armored vehicle from projectiles. Upon triggering of a module by a sensor which calculates the attack trajectory of the projectile, two plates which are oriented in mutually parallel relationship are flung apart by electromagnetic or preferably pyrotechnic means. The two plates are oriented approximately parallel to the attack trajectory, and one of the two plates is acullerated parallel to the attack trajectory and hits the approaching projectile thereby altering the angle of the indecence to reduce kinetic energy or trigger the warhead. Even if the projectile impacts against the vehicle, penetration of the vehicle armor may be avoided.

U.S. Pat. No. 5,824,941 to Knapper discloses another arrangement for protection from attack by projectiles. This arrangement consists of a wall which is constituted of explosives and is arranged obliquely relative to the firing direction below a wall facing towards the projectile. A foil consisting of an explosive for the formation of a or composite armor is equipped with a steel plate on one side thereof and with a glass plate or a glass fiber-reinforced plastic material plate on its other side. The composite armor forms chambers within a box structure such that, within any one chamber, a steel plate is always located opposite a glass plate. Collective foils of explosive are connected along their bottom sides with a transmission or transfer foil which is similarly constituted from an explosive.

U.S. Pat. No. 6,029,558 to Stevens et al. discloses a counter-terrorism, reactive personnel protection system which detects the presence of a conclusive shock wave or ballistic projectile as it approaches a designed personnel target. Before impact, an air bag is rapidly inflated and interposed between the destructive force and the target so as to provide a protective barrier. The air bag is constructed from ultra-high molecular weight polyethylene material, and serves to halt or redirect the detected destructive force and thereby protect the designated target from attack.

U.S. Pat. No. 6,244,156 to Stuer, et al discloses a blast shell which is launched as a defense against an attacking tail fin-stabilized projectile, such as, in particular, a KE penetrator, directed toward an object which is to be protected. Gas fumes and a reaction pressure blast wave from a fired blast warhead of the shell act principally on the tail region of the attacking projectile. The penetrator is thereby deflected from a trajectory in the attack direction so that the object under attack is either missed or at least is not hit in a head-on direction. The effectiveness of the attacking projectile is thereby reduced.

A need still exists, however, for a still more efficient means for protecting potential targets such as vehicles, aircraft, gun emplacements, ships and troop concentrations and the like from high speed projectiles.

SUMMARY OF THE INVENTION

High speed projectiles have a plasma sheath associated with them in flight. Laser radiation of a wavelength not absorbed by the atmosphere can couple to the plasma and be absorbed. The absorbed energy increases the temperature and therefore the pressure on one side of the projectile, thus providing a deflection force. The required transverse momentum is some fraction of the projectile momentum. Larger projectiles which have greater momentum have larger transverse areas so the applied force ($F=\Delta pA$) increases with area for the same pressure increase. Furthermore, larger projectiles are fired from longer ranges which provides greater lever arms for deflection, therefore requiring smaller angles of deflection. In addition assymetric drag force, may in turn deflect the projectile.

The present invention comprises a method for deflecting a projectile from an initial trajectory which takes advantage of this plasma sheaf. Such a projectile has a first surface area and a second surface area and moves through a gaseous atmosphere with a surrounding plasma sheath. This method includes the step of directing electromagnetic radiation toward the projectile, wherein the electromagnetic radiation has a frequency which is absorbed by the plasma sheath but is not substantially absorbed by the gaseous atmosphere. Ordinarily the electromagnetic radiation will be directed toward the first surface area of the projectile in preference to the second surface area of the projectile. The first surface area and the second surface area are in opposed relation to each other. For example, the first surface area may be an upper surface area and the second surface area may be lower surface. Alternatively, the first surface area may be a front area and the second surface area may be a side area. The electromagnetic radiation is preferably light from a laser. The electromagnetic radiation causes the plasma sheath to be heated. The plasma sheath may be considered to have a first section adjacent the first surface area of the projectile and a second section adjacent the second surface area of the projectile. A temperature differential between the first section of the plasma sheath and the second plasma sheath results from directing the electromagnetic radiation toward the first surface area in preference to the second surface area. This temperature differential results in a pressure differential between said first surface area and said second surface area. Accordingly a traverse momentum is applied to the projectile resulting in a transverse impulse. The transverse impulse results in a deflecting force. The projectile may be a self-propelled rocket, an externally propelled shell, or an air delivered bomb. A fast moving projectile, as that term is used herein, will mean that the projectile will ordinarily have a velocity of from about 300 m/sec. to about 1500 m/sec.

BRIEF DESCRIPTION OF THE DRAWINGS

The present invention is further described with reference to the accompanying drawings wherein.

DETAILED DESCRIPTION OF THE PREFERRED EMBODIMENT

Figure 1:
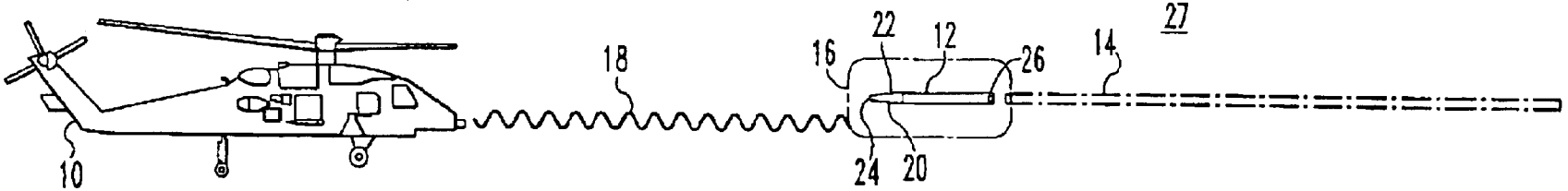
FIG. 1 is a side elevational view of a target aircraft and a projectile illustrating a first step in the method of the present invention.

Referring to FIG. 1, there is shown a target aircraft 10 and a projectile 12 which in this case is an air to air missile. The projectile 12 has an exhaust plume 14 which is indicative of a horizontal trajectory which puts its on an initial path directly toward the aircraft 10. The projectile 12 has a plasma sheath 16. A laser beam 18 is directed from the aircraft 10 toward the projectile 10 and the plasma sheath 16. The projectile 12 has a lower side 20 and an upper side 22 and front end 24 and a rear end 26. The laser beam 18 is made up of electromagnetic radiation which preferably has a wavelength of between 0.35 microns and 0.70 microns. In any case, the frequency should be selected so that the electromagnetic radiation is absorbed to a significant degree by the sheath 16 but not absorbed to a significant degree by the surrounding atmosphere 27. The laser beam 18 is directed to one side 20 of the projectile 12 relative to the other side 22 of the projectile 12 and its surrounding air and plasma sheath will tend to be heated more than its opposed side 22 and surrounding air and plasma sheath. In the case shown, the side 20 and its surrounding air and plasma sheath will tend to be heated to a higher temperature relative to the other side 22 and its surrounding air and plasma sheath and the surrounding atmosphere 27. Air pressure on the side 20 of the projectile 12 relative to the air pressure at the other side 22 of the projectile 12 will therefore tend to be higher with the result that the projectile 12, will tend to yaw or be deflected upwardly.

Figure 2:
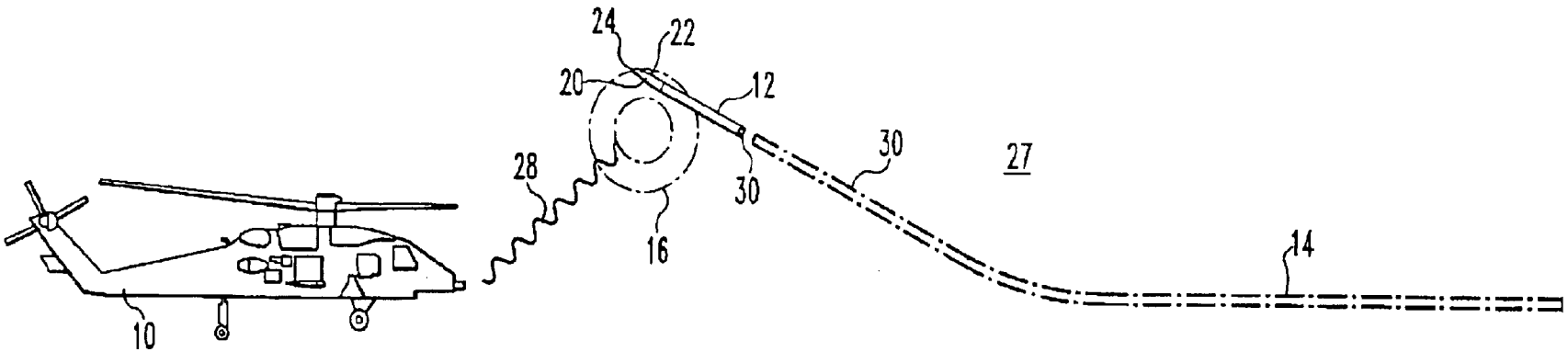
FIG. 2 is a side elevational view of the target aircraft and the projectile illustrating a second step in the method of the present invention.

Referring to FIG. 2, the method of the present invention continues with the target aircraft maintaining an obliquely directed laser beam 28 on the projectile 12. It will be noted that the exhaust plume 30 and the trajectory of the projectile extend obliquely upwardly relative to the positions shown in FIG. 1. At this point the laser would ordinarily be deactivated so that the projectile 12 would generally follow this upwardly oblique trajectory and thereby miss the target aircraft 10.

EXAMPLE

It is desired to deflect a projectile away from a target. The projectile has a speed of 1,000 m/sec. The projectile is at a range of about 3 km from the target, and has a mass of about 0.5 kg. The projectile is cylindrical in shape and has a length of 63.5 mm and a diameter of 23 mm. It is desired to deflect the projectile by about 6 m. The following relationships are pertinent to this situation.

Impulse=FORCE×TIME

FORCE=PRESSURE×AREA

PRESSURE=C×TEMPERATURE (where C is ideal gas constant/volume)

Temp=Cv×Q (where Cv is specific heat)

Cv varies with particular Absorber (e.g. gas, plasma)

PV=NKT

Under the above circumstances, one of ordinary skill in the art will appreciate that a laser beam might be directed toward the projectile in the way described above to apply 212 J packets of energy over 0.1 sec. to deflect the projectile in the desired way.

It will be appreciated that a method has been described which will allow for an efficient and cost effective means for shielding or protecting a target from a high speed projectile. Such targets may include, but not be limited to, surface vehicles, aircraft, gun emplacements, ships and troop concentrations.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordandce with the recitation of the appended claims.

What is claimed is:

1. A method for deflecting a projectile from an initial trajectory, said projectile having a first surface area and a second surface area and moving through a gaseous atmosphere with a surrounding plasma sheath, said method comprising the step of:

directing electromagnetic radiation toward the projectile, wherein said electromagnetic radiation has a frequency which is absorbed by the plasma sheath to a significant degree but is not absorbed by the gaseous atmosphere to a significant degree.

2. The method of claim 1 wherein the electromagnetic radiation is directed toward the first surface area of the projectile in preference to the second surface area of the projectile.

3. The method of claim 2 wherein the first surface area and the second surface area are in opposed relation to each other.

4. The method of claim 3 wherein the first surface area is a lower surface area and the second surface area is an upper surface area.

5. The method for claim 2 wherein the first surface area is an upper surface area and the second surface area is a lower surface area.

6. The method of claim 2 wherein the first surface area is a front surface area and the second surface area is a side surface area.

7. The method of claim 2 wherein the first surface is a front surface and the second surface is a side surface.

8. The method of claim 7 wherein the electromagnetic radiation has a source which is a laser.

9. The method of claim 1 wherein the electromagnetic radiation is light.

10. The method of claim 1 wherein the electromagnetic radiation causes the plasma sheath to be heated.

11. The method of claim 10 wherein the plasma sheath has a first section adjacent the first surface area of the projectile and a second section adjacent the second surface area of the projectile and there is a temperature differential said first section of the plasma sheath and the second section of the plasma sheath and the temperature differential results in a pressure differential between said first surface area and said second surface area.

12. The method of claim 11 wherein there is a traverse momentum applied to the projectile.

13. The method of claim 12 wherein the transverse momentum results in a transverse impulse which results in a deflecting force.

14. The method of claim 1 wherein the projectile is a self-propelled rocket.

15. The method of claim 1 wherein the projectile is an externally propelled shell.

16. The method of claim 1 wherein the projectile is an air delivered bomb.

17. The method of claim 1 wherein the electromagnetic radiation has a wave length of from 0.35 microns to 0.70 microns.

18. The method of claim 1 wherein the projectile has a velocity of from about 300 m/sec. to about 1500 m/sec.

19. A method for deflecting a projectile from an initial trajectory, said projectile having a first surface area and a second surface area and is moving through a gaseous atmosphere with a surrounding plasma sheath, said method comprising the step of:

directing electromagnetic radiation toward the projectile, wherein said electromagnetic radiation has a frequency so that the electromagnetic radiation is absorbed to a significant degree by the plasma sheath but is not absorbed to a significant degree by the gaseous atmosphere, wherein the electromagnetic radiation is directed toward the first surface area of the projectile in preference to the second surface area of the projectile.

20. A method for deflecting a projectile from an initial trajectory, said projectile having a first surface area and a second surface area and is moving through a gaseous atmosphere with a surrounding plasma sheath, said method comprising the step of:

directing electromagnetic radiation toward the projectile, wherein said electromagnetic radiation has a frequency which is absorbed by the plasma sheath but is not substantially absorbed by the gaseous atmosphere, wherein the electromagnetic radiation causes the plasma sheath to be heated, and the plasma sheath has a first section adjacent the first surface area of the projectile and a second section adjacent the second surface area of the projectile and there is a temperature differential between said first section and said second section of the plasma sheath.

* * * * *